US006868611B2

(12) United States Patent
Geertsma et al.

(10) Patent No.: US 6,868,611 B2
(45) Date of Patent: Mar. 22, 2005

(54) SHAVING APPARATUS

(75) Inventors: Geert Geertsma, Drachten (NL); Simon Eme Kadijk, Drachten (NL); Hendrik Poel, Drachten (NL); Sjoerd Haites, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 124 days.

(21) Appl. No.: 10/011,969

(22) Filed: Dec. 3, 2001

(65) Prior Publication Data

US 2002/0083591 A1 Jul. 4, 2002

(30) Foreign Application Priority Data

Dec. 6, 2000 (EP) ..... 00204353

(51) Int. Cl.[7] ..... B26B 19/14
(52) U.S. Cl. ..... 30/43.6; 30/346.51
(58) Field of Search ..... 30/43.6, 346.51, 30/43.4, 34.2

(56) References Cited

U.S. PATENT DOCUMENTS

| | | | | | |
|---|---|---|---|---|---|
| 2,494,463 | A | * | 1/1950 | Vivie | 30/43.6 |
| 2,616,168 | A | * | 11/1952 | Dankers | 30/43.6 |
| 4,139,940 | A | * | 2/1979 | Buras et al. | 30/346.51 |
| 4,310,968 | A | * | 1/1982 | Buik et al. | 30/34.2 |
| 4,393,586 | A | * | 7/1983 | Hamashima et al. | 30/43.6 |
| 4,888,870 | A | | 12/1989 | Fujikawa et al. | 30/233.5 |
| 5,689,883 | A | * | 11/1997 | Ortiz et al. | 30/34.2 |
| 6,085,421 | A | * | 7/2000 | Jorna et al. | 30/43.6 |
| 6,199,282 | B1 | * | 3/2001 | Uchiyama et al. | 30/43.6 |

* cited by examiner

*Primary Examiner*—Stephen Choi

(57) ABSTRACT

A shaving apparatus with an external cutting member (4) and an internal cutting member which can be driven into rotation relative to the external member. The external cutting member (4) has an annular region (8) with hair-trapping apertures (5) and a skin support region (9) in a central area surrounded by the annular region. To improve the shaving performance, the skin support area is provided with ridges 10.

20 Claims, 3 Drawing Sheets

SHAVING APPARATUS

BACKGROUND OF THE INVENTION

The invention relates to a shaving apparatus with at least one cutting unit which comprises an external cutting member and a matching internal cutting member, said external cutting member being provided with an annular region with hair-trapping apertures and a skin support surface situated within (that is, in a central area surrounded by) the annular region.

Such a shaving apparatus is known from U.S. Pat. No. 6,085,421. The skin support surface is formed here by a decorative cover which has a slightly convex shape, such that the skin is in substantially full contact with the support surface during shaving. The contact surface as a result is very large, so that the user experiences a considerable frictional resistance during shaving.

BRIEF SUMMARY OF THE INVENTION

It is an object of the invention to cause the frictional resistance between the external cutting member and the skin to be as small as possible during shaving with the shaving apparatus mentioned above.

According to the invention, the shaving apparatus is for this purpose characterized in that the skin support surface is provided with a number of ridges.

As a result of this, the skin rests partly on the ridges during shaving, so that the contact surface area is smaller than with the shaving apparatus of the prior art. The frictional resistance is smaller and the shaving apparatus slides more smoothly over the skin.

Preferably, the ridges are present in an annular region directly adjoining the annular region with the hair-trapping apertures. The advantage of this is that the hairs are guided between the ridges to the hair-trapping apertures during shaving. Such ridges accordingly at the same time serve as hair-guiding means.

A further preferred embodiment is characterized in that a central portion of the skin support surface has a concave shape. This, too, reduces the frictional resistance between the skin and the cutting member during shaving.

BRIEF DESCRIPTION OF THE SEVERAL VIEWS OF THE DRAWING

The invention will now be explained in more detail below with reference to an embodiment.

DETAILED DESCRIPTION OF THE INVENTION

Figure 1:
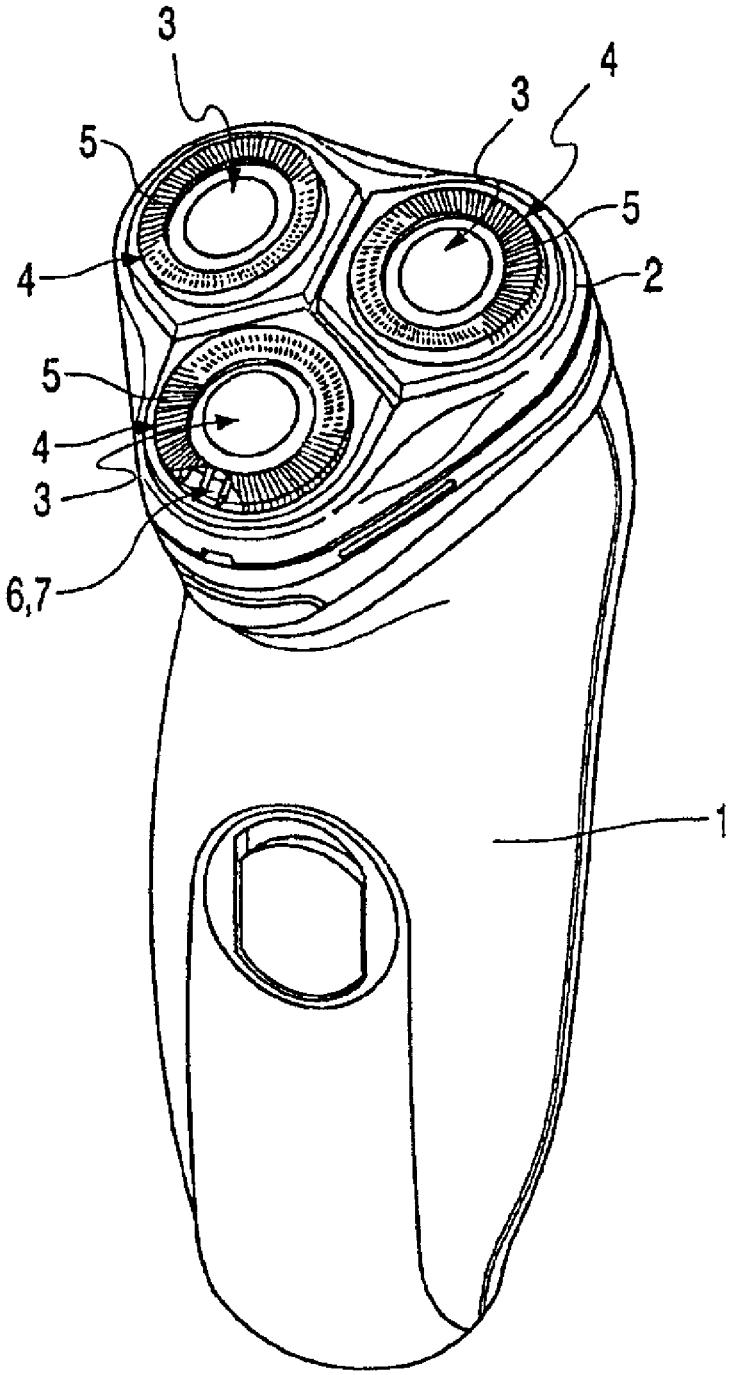
FIG. 1 shows a shaving apparatus with three cutting units.

FIG. 1 shows a rotary shaving apparatus with a housing 1 and a shaving-head holder 2, which holder can be detached from the housing and/or is hinged to the housing. Three cutting units 3, also called shaving heads, are present in the shaving-head holder, each comprising an external cutting member 4 with hair-trapping apertures 5 and an internal cutting member 6 with cutter elements 7 (see also FIG. 3) which can be driven into rotation with respect to the former member. The internal cutting member is driven by a motor (not shown) in the housing of the shaving apparatus in a known manner.

Figure 2:
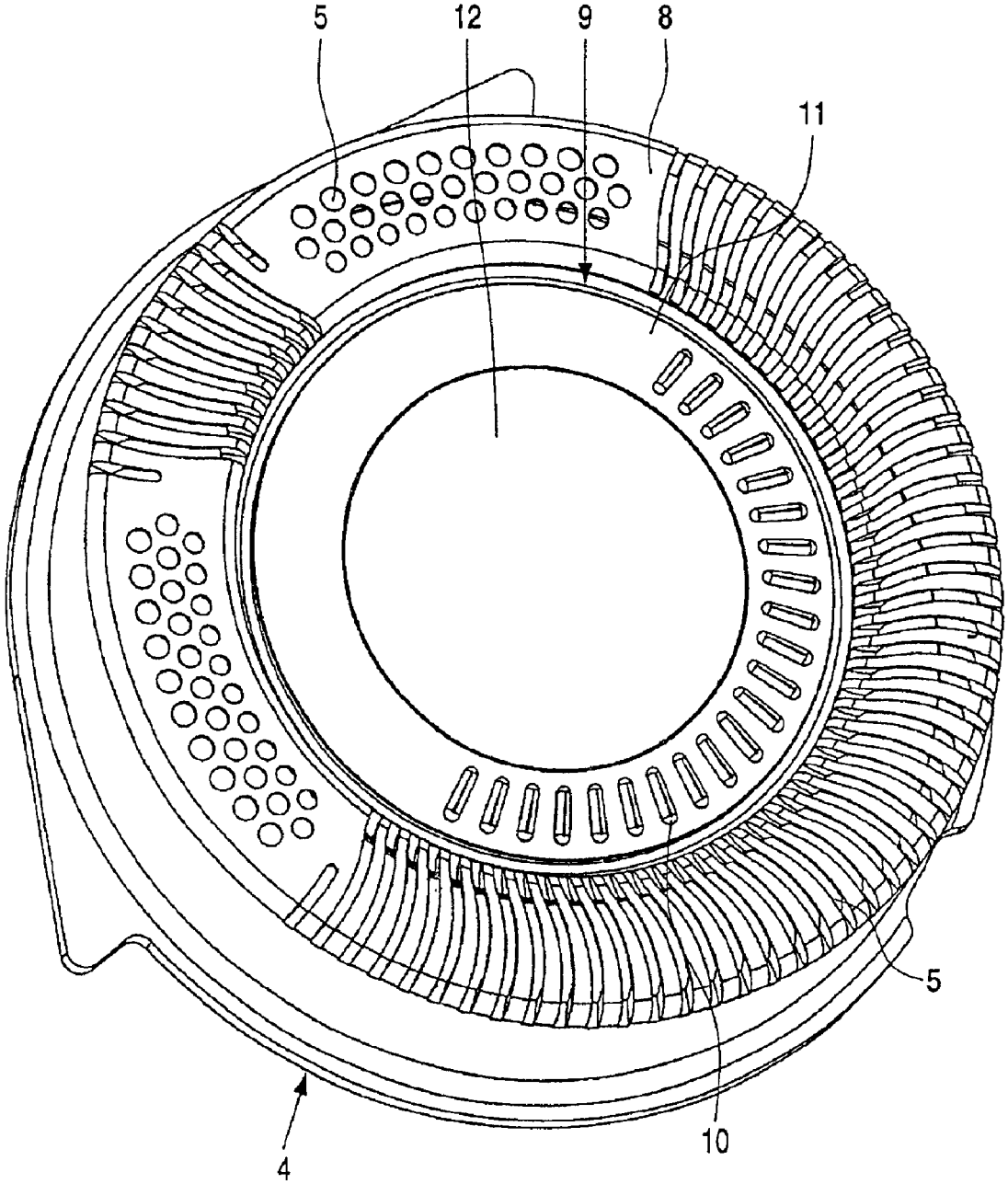
FIG. 2 shows an external cutting member in perspective view.
Figure 3:
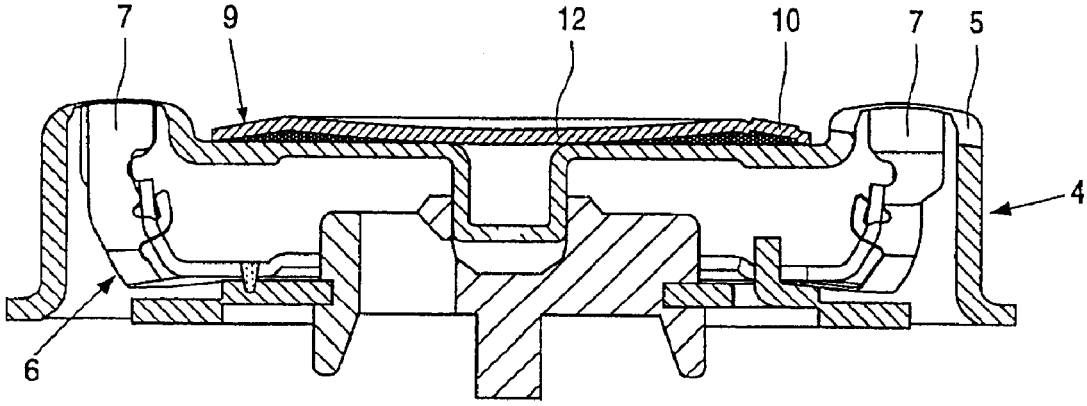
FIG. 3 is a cross-sectional view of the external cutting member of FIG. 2.

FIGS. 2 and 3 show the external cutting member 4 on an enlarged scale. The external cutting member comprises an annular region 8 in which the hair-trapping apertures 5 are present. Inside this annular region 8 there is a decorative cover which serves as a skin support surface 9. A number of ridges 10 are provided on this decorative cover 9. In FIG. 2, the ridges lie in an annular region substantially directly adjacent the annular region with the hair-trapping apertures 5. The skin is supported by the ridges during shaving, so that the frictional resistance between the skin and the decorative cover is smaller than if no ridges were present. Obviously, the ridges may be provided in any location on the surface of the decorative cover. If the ridges are provided in an annular region 11 substantially directly adjacent the annular region 8 with the hair-trapping apertures 5, as shown in FIG. 2, this at the same time has the advantage that the hairs are guided between the ridges 10 during shaving and accordingly enter the hair-trapping apertures 5 more easily. This is effective especially if the hair-trapping openings are formed by slots which are approximately radially directed, as shown in FIG. 2. This leads to a better shaving result.

The frictional resistance may be further reduced in that the central portion 12 of the decorative cover 9 has a concave shape (see FIG. 3). The pressure obtaining between the skin and said concave central portion will be smaller then during shaving than if the central portion were to have a planar or convex shape. A lower pressure again results in a lower frictional resistance, especially if the surface of the decorative cover has a structure with a higher roughness, whereby any sticking effect is reduced.

What is claimed is:

1. A shaving apparatus with at least one cutting unit (3) which comprises an external cutting member (4) and a matching internal cutting member (6), said external cutting member being provided with a central area free from apertures and with an annular region (8) surrounding said central area and having hair-trapping apertures (5), and a skin support surface (9) situated within said central area, characterized in that the skin support surface (9) is provided with a plurality of ridges (10).

2. A shaving apparatus as claimed in claim 1, characterized in that the ridges are present in a second annular region (11) situated within said central area directly adjoining the annular region (8) with the hair-trapping apertures (5).

3. A cutting unit with an external cutting member (4) and an internal cutting member (6), said external cutting member being provided with a skin support surface (9) as claimed in claim 2.

4. A shaving apparatus as claimed in claim 2, characterized in that a central portion (12) of said skin support surface (9) situated within said central area has a concave shape.

5. A shaving apparatus as claimed in claim 4, characterized in that said ridges extend approximately radially.

6. A shaving apparatus as claimed in claim 2, characterized in that said ridges extend approximately radially.

7. A shaving apparatus as claimed in claim 1, characterized in that a central portion (12) of said skin support surface (9) situated within said central area has a concave shape.

8. A cutting unit with an external cutting member (4) and an internal cutting member (6), said external cutting member being provided with a skin support surface (9) as claimed in claim 7.

9. A cutting unit with an external cutting member (4) and an internal cutting member (6), said external cutting member being provided with a skin support surface (9) as claimed in claim 1.

10. A cutting unit with an external cutting member (4) and an internal cutting member (6), said external cutting member being provided with a skin support surface (9) as claimed in claim 1, and further characterized in that said ridges extend approximately radially.

11. A shaving apparatus as claimed in claim 1, characterized in that said ridges extend approximately radially.

12. A shaving apparatus with at least one cutting unit (3) which comprises an external cutting member (4) and a matching internal cutting member (6), said external cutting member being provided with a central area free from hair-trapping apertures and with an annular region (8) surrounding said central area and having hair-trapping apertures (5), and a skin support surface (9) situated within said central area, characterized in that the skin support surface (9) is provided with a plurality of ridges (10), the skin support surface (9) being free from apertures between said ridges.

13. A shaving apparatus as claimed in claim 12, characterized in that said ridges extend approximately radially.

14. A shaving apparatus as claimed in claim 12, characterized in that a central portion (12) of said skin support surface (9) situated within said central area has a concave shape.

15. A cutting unit with an external cutting member (4) and an internal cutting member (6), said external cutting member being provided with a skin support surface (9) as claimed in claim 14.

16. A shaving apparatus as claimed in claim 12, characterized in that the ridges are present in a second annular region (11) situated within said central area directly adjoining the annular region (8) with the hair-trapping apertures (5).

17. A shaving apparatus as claimed in claim 16, characterized in that a central portion (12) of said skin support surface (9) situated within said central area has a concave shape.

18. A cutting unit with an external cutting member (4) and an internal cutting member (6), said external cutting member being provided with a skin support surface (9) as claimed in claim 16.

19. A cutting unit with an external cutting member (4) and an internal cutting member (6), said external cutting member being provided with a skin support surface (9) as claimed in claim 12.

20. A cutting unit with an external cutting member (4) and an internal cutting member (6), said external cutting member being provided with a skin support surface (9) as claimed in claim 12, and further characterized in that said ridges extend approximately radially.

* * * * *